United States Patent [19]

Bessette

[11] 4,051,785

[45] Oct. 4, 1977

[54] DUAL DISCHARGE HOPPER DEVICE FOR BULK CARGO VEHICLES

[76] Inventor: Richard P. Bessette, 13029 S. Hoyne Ave., Blue Island, Ill. 60406

[21] Appl. No.: 691,465

[22] Filed: June 1, 1976

[51] Int. Cl.[2] ..... B61D 7/06

[52] U.S. Cl. ..... 105/280; 105/282 P; 298/24

[58] Field of Search ..... 105/280, 282 P, 239–259; 298/24–37; 222/564, 527, 530

[56] References Cited

U.S. PATENT DOCUMENTS

| | | | |
|---|---|---|---|
| 1,026,694 | 5/1912 | Neikirk | 105/243 |
| 1,482,559 | 2/1924 | Hart | 298/24 X |
| 3,396,675 | 8/1968 | Stevens | 105/280 |
| 3,511,188 | 5/1970 | Danielson | 105/280 |

*Primary Examiner*—Robert J. Spar

*Assistant Examiner*—Donald W. Underwood

*Attorney, Agent, or Firm*—Wegner, Stellman, McCord, Wiles & Wood

[57] ABSTRACT

A dual discharge hopper device for the cargo body of a bulk cargo carrying wheeled vehicle has at least one transverse side wall which is pivoted and releasably latched for free discharge of material from the cargo body, and also has a bottom closure which provides for controlled discharge of material. A diverter panel is mounted on a shaft at the bottom of the device alongside the pivoted side wall, and is movable between a controlled discharge position in which it confronts the pivoted sidewall, and a free discharge position in which it lies diagonally across the device to block the controlled discharge closure. Two opposite sidewalls may be pivoted, in which case there are two diverter panels the upper ends of which effectively meet to block the controlled discharge closure.

18 Claims, 13 Drawing Figures

W
W3
41
W1
W2
W4
B
27
26
25
24
22
20
39
22a
21
31
34
37
36
32
33
35
28
30
40
29a
29

127a
141a
121
141
127
142
139a
122
139
125
124
140a
130
140
129

127a
127
142
122
139a
139
124
140a
130
140
129
129

7.
S
241
243
239
245
227
244
222
221
239
225
224
230
240
7.

241
243
239
S
245
223
222
230
240

DUAL DISCHARGE HOPPER DEVICE FOR BULK CARGO VEHICLES

BACKGROUND OF THE INVENTION

Bulk cargo carrying wheeled vehicles such as railroad hopper cars are usually constructed to discharge bulk cargo either in a controlled discharge or in an uncontrolled discharge. Typically, a carload of wheat or other grain must be discharged in a controlled manner for proper handling. Conversely, bulk cargo such as coal and crushed stone or gravel are usually dumped from a railroad car in an uncontrolled discharge.

The mechanism for providing a controlled discharge is necessarily quite different from that required for uncontrolled discharge; and heretofore no simple and inexpensive means has been devised for unloading a bulk cargo selectively either in a controlled manner or an uncontrolled manner.

A dual discharge hopper — i.e., one which can discharge bulk cargo either in a controlled manner or an uncontrolled manner, is very desirable because it permits a bulk cargo carrying vehicle to be used with a much wider variety of bulk cargos than can any car which is capable of being discharged only in one of the two ways. One of the reasons that there is frequently a shortage of railroad cars for moving grain at harvest time is that there is little use for such cars at any other time; and the railroads cannot afford to keep a huge stock of controlled discharge bulk cargo cars if they must be inactive most of the year.

Applicant is aware of only two dual discharge hopper structures, which are those disclosed in U.S. Pat. No. 3,396,675 and 3,511,188. Each of them discloses a relatively complex system in which a hopper has a linkage mounted bottom closure for free discharge of material, and on the linkage mounted closure is a crank operated, controlled discharge closure. While such structures function satisfactorily, they are relatively complex and expensive.

SUMMARY OF THE INVENTION

In accordance with the present invention, a dual discharge hopper device for the cargo body of a bulk cargo carrying wheeled vehicle has either one wall or two opposite walls which are hinged at the top and may be latched shut. When the latch or latches are released, the hinged wall or walls swing outwardly to permit bulk cargo to be discharged from the hopper in an uncontrolled fashion. The hopper also has a controlled discharge bottom closure which can be opened to any desired extent by means of a rack and pinion mechanism. A diverter panel is associated with each of the pivoted sidewalls and is mounted upon a shaft at the bottom of the hopper so that it may be swung between a controlled discharge position in which it blocks cargo in the hopper from bearing on the uncontrolled discharge pivoted wall, and a position extending diagonally across the hopper to prevent material from bearing upon the controlled discharge bottom closure and to force material to be discharged through the opening left when the pivoted wall swings outwardly. The shaft for the diverter panel has an end portion projecting outside the confines of the hopper wall where it may be rotated by a torque producing device to swing the diverter panel from one position to the other.

A bulk cargo carrying wheeled vehicle equipped with the dual discharge hopper device of the present invention is very simple and inexpensive. It provides a means by which a bulk cargo carrying car can be used for other cargos during most of the year and easily adapted to grain handling by swinging the diverter panel to its controlled discharge position and providing the car with a lightweight plastic cover to protect the grain in the car from precipitation.

THE DRAWINGS

FIG. 1. is a perspective view of a dual discharge hopper device embodying the invention, with the cargo body shown only fragmentarily;

DETAILED DESCRIPTION OF THE INVENTION

Figure 1:
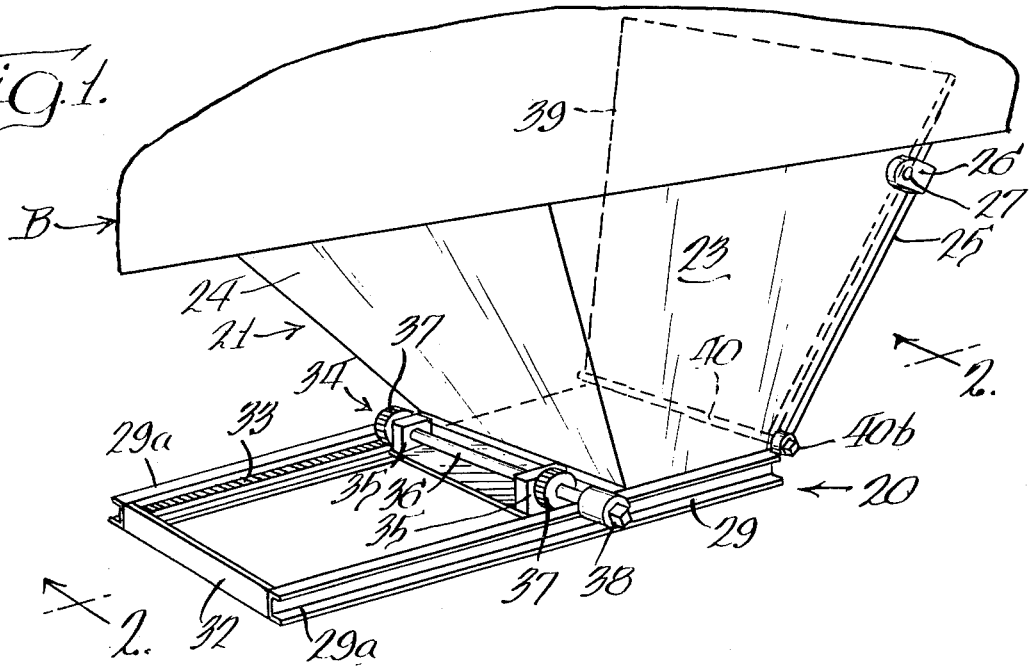
Figure 2:
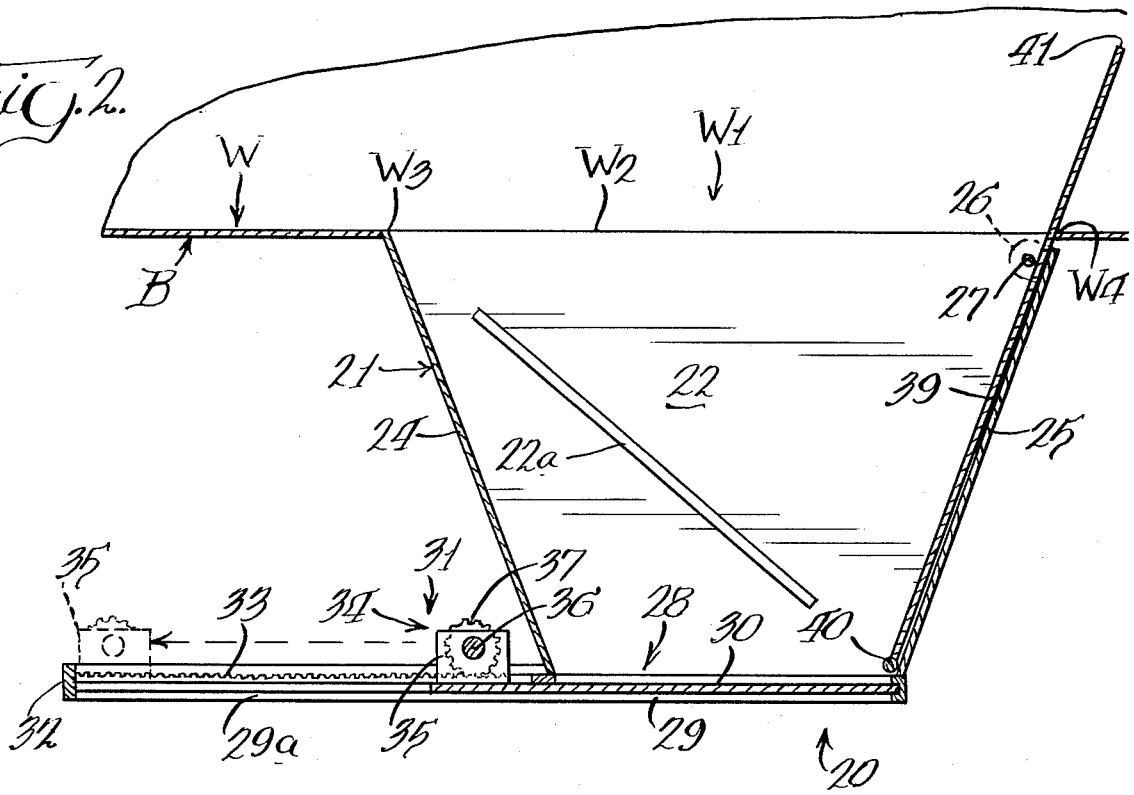
FIG. 2 is a longitudinal sectional view on an enlarged scale taken substantially as indicated along the line 2—2 of FIG. 1 with the diverter panel in a controlled discharge position.
Figure 3:
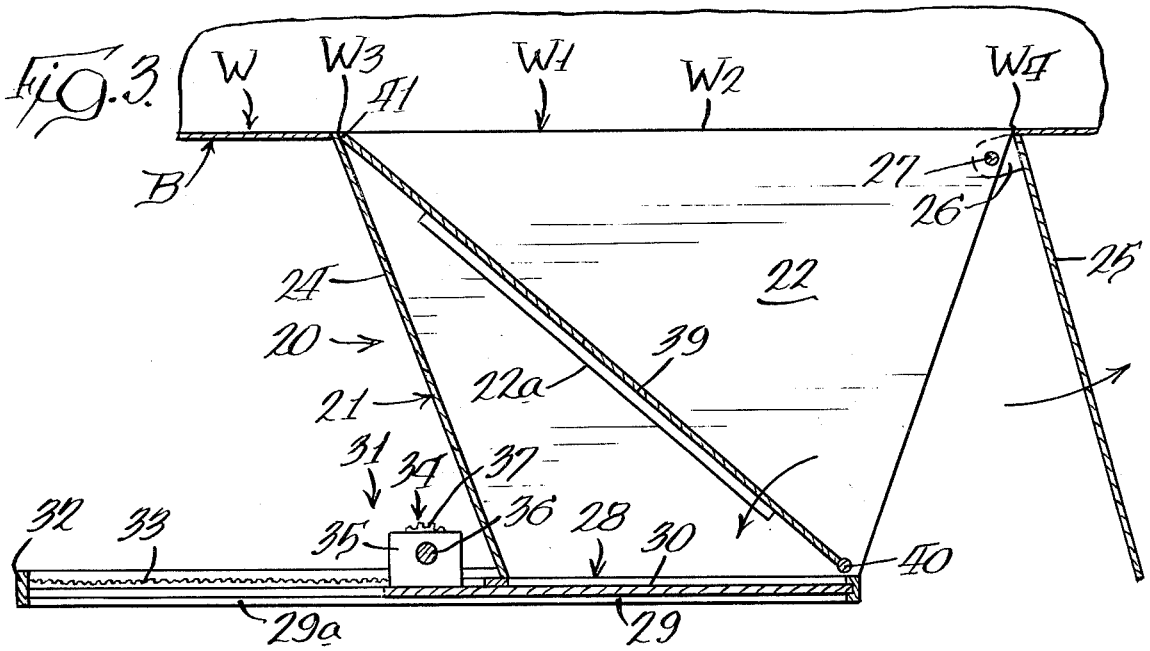
FIG. 3 is a view like FIG. 2 with the diverter panel positioned for the uncontrolled discharge of material.

Referring to the drawings in greater detail, and referring first to FIGS. 1 to 3, the lower end portion of a cargo body B of a bulk cargo carrying wheeled vehicle is seen to include a bottom wall W which may be horizontal, but which is usually inclined and which is provided with a rectangular opening W1 that has first parallel sides consisting of a side W2 and a side which is not shown, and second parallel sides W3 and W4 which commonly extend transversely of the cargo body B. It is to be understood that in the vast majority of cases the cargo body B is a part of a railway car, although the invention is equally applicable to a bulk cargo carrying semi-trailer or trailerintended for highway use.

A first embodiment of the dual discharge hopper device of the present invention is indicated generally at 20, and includes a depending structure, indicated generally at 21, which has two fixed sidewalls 22 and 23 the upper margins of which bound the first parallel sides of the rectangular opening W1. The depending structure 21 also includes two connecting walls 24 and 25 the upper ends of which bound the second parallel sides W3 and W4 of the opening. The connecting wall 25 has a pair of pivot ears 26 which flank the upper end portions of the fixed sidewalls 22 and 23 immediately adjacent the bottom wall W of the cargo body B. Aligned pivot pins 27 which extend laterally outwardly from the upper ends of the fixed sidewalls 22 and 23 provide pivotal mountings for the pivot ears 26 and a pivot axis for the sidewall 25 which extends between the fixed sidewalls 22 and 23 immediately adjacent the bottom wall W of the cargo body. Thus, the wall 25 may selectively abut the fixed sidewalls 22 and 23 as seen in FIG. 2, or it may swing clear of said sidewalls as seen in FIG. 3 for the uncontrolled discharge of material from the cargo body. As is well known in the art, latch means (not shown) is provided to secure the connecting wall 25 in the closed position of FIG. 2. A shaft may be substituted for the pines 27.

The present device also includes controlled discharge closure means 28 at the bottom of the depending structure 21 which consists of horizontal channels 29 which extend beneath the fixed hopper structure sidewalls 22 and 23, and a closure 30 the side edge portions of which are carried in the channels 29. There is also discharge control means, indicated generally at 31, for moving the bottom closure 30 between the closed position of FIG. 2 and a fully open position in which the closure member 30 abuts a stop bar 32 which is mounted between lateral extensions **29*a* of the channels 29. The discharge control means 31 includes a pair of racks, such as the rack 33 seen in FIGS. 1 and 2, which are mounted in the extensions 29*a* of the channels above the plane of the bottom closure 30; and in addition the discharge control means includes a pinion assembly, indicated generally at 34, which includes bearing blocks 35 that surmount the bottom closure 30 outside the fixed connecting wall 24, a shaft 36 mounted in the bearing blocks, and a pair of pinions 37 which are keyed to the shaft 36 and ride on the racks 33. As seen in FIG. 1, an extension of the shaft 36 past one of the channel members 29 has a square end portion 38 to receive a manual crank (not shown) for applying torque to the shaft 36 for the purpose of moving the closure member 30 to any desired point between its fully closed limit position and its fully open limit position abutting the stop bar 32. Obviously, both end portions of the shaft 36** may be constructed to receive a crank if desired.

The lateral extensions **28*a* of the channels 29 may be on any side of the depending structure 21 that has a fixed wall; but may not be where there is a pivoted wall because of clearance problems, and also because of damage to the extensions 29*a*** during uncontrolled discharge of material.

Finally, the dual discharge hopper device of the present invention includes a diverter panel 39 is mounted on a horizontal shaft 40 that extends between the lower ends of the fixed sidewalls 22 and 23 immediately adjacent the pivotable connecting wall 25. The horizontal shaft 40 has a projecting end portion **40*b* which is square so that a manual crank may be used to apply torque to the shaft 40 for the purpose of moving the diverter panel 39 from the position of FIG. 2 to the position of FIG. 3; or it may have two such end portions. In the position of FIG. 2 the diverter panel is in a generally upright, controlled discharge position confronting the pivoted connecting wall 25 where it prevents uncontrolled discharge of material from the cargo body B even if the pivoted connecting wall 25 is inadvertently unlatched. In the position of FIG. 3 the diverter panel 39 is inclined across the depending hopper structure 21 so that its free end 41 rests against the extreme upper end of the fixed connecting wall 24 so as to totally obstruct the lower end of the depending hopper structure for uncontrolled discharge of material through the opening created by the outward swinging movement of the pivoted connecting wall 25**.

Preferably the fixed sidewall 22 and its unillustrated counterpart are provided with inclined bars **22*a* which support the diverter panel 39** in its inclined position or alternatively said sidewalls may be inwardly indented to provide such support.

In order to convert a bulk cargo carrying vehicle from one for uncontrolled discharge to one for controlled discharge requires only that the diverter panel 39 be swung manually from the position of FIG. 3 to the position of FIG. 2 before the cargo body is loaded with a bulk cargo which requires controlled discharge.

Although the depending hopper structure 21 is shown in the drawings as being tapered from top to bottom on all four sides, so that it is in the form of a frustum of a four-sided pyramid with all sides of substantially equal area, it is apparent that both of the sidewalls 22 and 23 could be vertical without changing the mode of operation of the device. Likewise, although it is usually essential that at least the pivoted connecting wall 25 be inclined for uncontrolled discharge of material, in the present structure the inclined, uncontrolled discharge position of the diverter panel 39 would force all material from the cargo body B to exit through the opening afforded by the outward swinging of the pivoted connecting wall 25 even if the latter were vertical.

The various embodiments of the invention illustrated in FIGS. 4 through 13 are shown somewhat schematically, in that in each case the hopper body B with its bottom wall W and the rectangular discharge opening W1 are omitted, and also in that the channels 29 and the discharge control means 31 are omitted. However, it is to be understood that in each case there is a hopper body with a bottom wall having a rectangular discharge opening below which the dual discharge hopper device is mounted with its sidewalls and its connecting walls bounding the sides of the discharge opening, and that in each case there are channels and rack and pinion means for effecting controlled movement of the bottom closure from a fully closed position to a fully open position.

Figure 4:
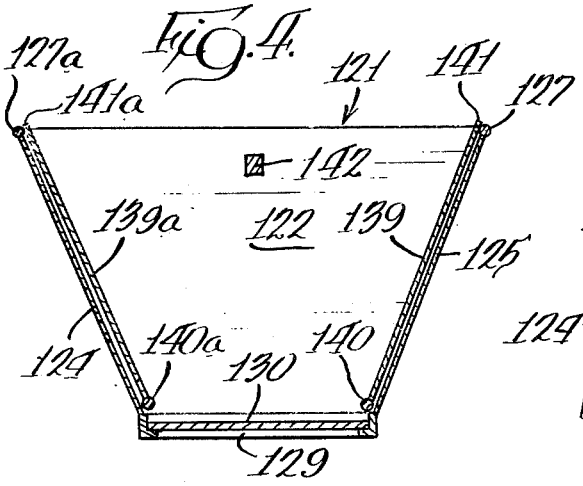
FIG. 4 is a view similar to FIG. 2, on a reduced scale, showing a dual discharge hopper which has two pivoted sidewalls and two pivoted diverter panels illustrated in controlled discharge position.
Figure 5:
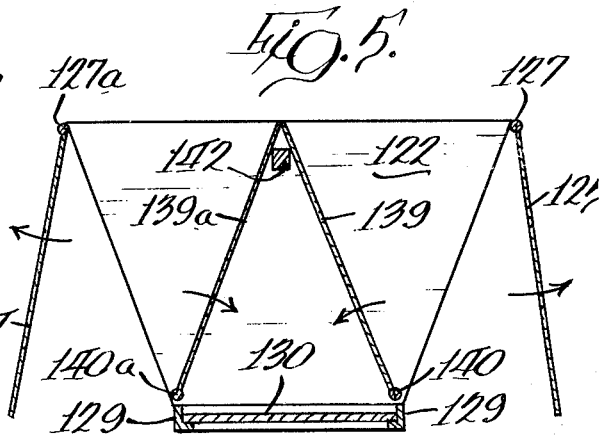
FIG. 5 is a view like FIG. 4 showing the pivoted sidewalls open and the two diverter panels in their position for uncontrolled discharge of material.

Referring now to FIGS. 4 and 5, elements of the second embodiment of the invention which have functions similar to those of the elements of the first embodiment are given like reference numerals, but one hundred numbers higher than the similar elements in the first embodiment. In the second embodiment, a depending hopper structure 121 has a first fixed sidewall 122 which bounds one of two parallel sides of a rectangular opening in the bottom wall of a cargo body, and a second fixed sidewall (not shown) bounds the second of said two parallel sides of said rectangular opening. Extending between the fixed walls are connecting walls 124 and 125, and in this embodiment both the wall 124 and the wall 125 are pivoted. Thus, there is a pivot 127 for the wall 125 and a pivot 127*a* for the wall 124. Accordingly, bulk cargo from the cargo body may be discharged in an uncontrolled fashion from both sides of the depending hopper structure 121.

Figure 11:
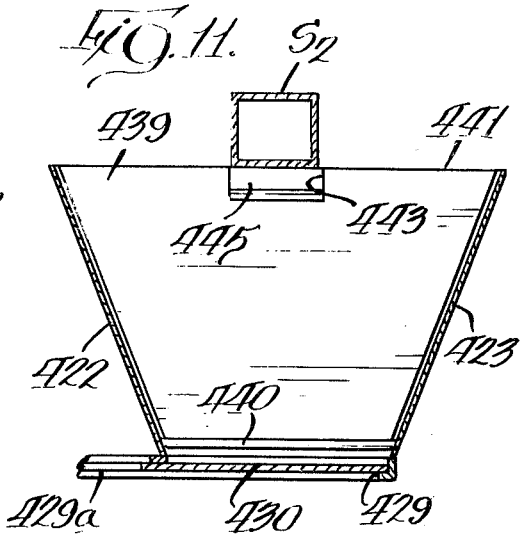
FIG. 11 is a sectional view taken substantially as indicated along the line 11—11 of FIG. 10.
Figure 13:
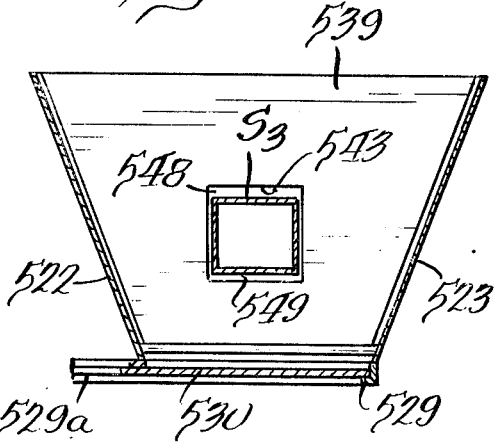
FIG. 13 is a sectional view taken substantially as indicated along the line 13—13 of FIG. 12.

In order to provide the desired dual discharge for the second embodiment, there is a diverter panel 139 pivotally mounted on a shaft 140 for controlling discharge through the pivoted connecting wall 125, and there is a second diverter panel 139*a* pivoted on a shaft 140*a* to control discharge through the pivoted connecting wall 124. The device is provided with a controlled discharge bottom closure 130 which functions precisely like the controlled discharge bottom closure 30 of the first embodiment, by moving in channels 129. However, as previously stated, the extensions of the channels must be past one of the fixed sidewalls such as the sidewall 122, and thus are not shown in FIG. 4 or FIG. 5. FIGS. 11 and 13 show the channel extensions past fixed sidewalls 422 and 522, respectively. On the vertical median plane between the vertical planes of the shafts 140 and 140*a* is a stop bar 142 which extends between the fixed sidewalls in order to support the diverter panels 139 and 139*a* in their inclined, uncontrolled discharge positions with their respective upper ends 141 and 141*a* abutting so that the diverter panels cooperate to completely block material from resting upon the controlled discharge bottom closure 130.

Figure 6:
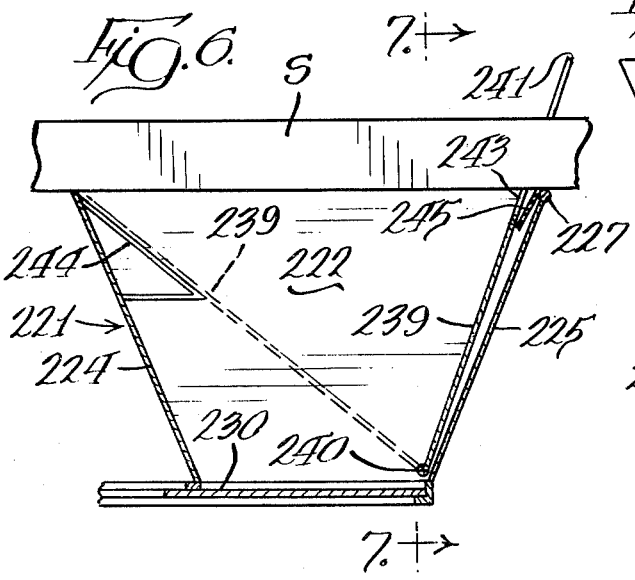
FIG. 6 is a longitudinal sectional view of a device similar to that of FIG. 1 but modified to accommodate it to a cargo body which has a structural beam or sill at the bottom where it runs along the top of the hopper device, the diverter panel being illustrated in solid lines in its controlled discharge position and in broken lines in its uncontrolled discharge position.
Figure 7:
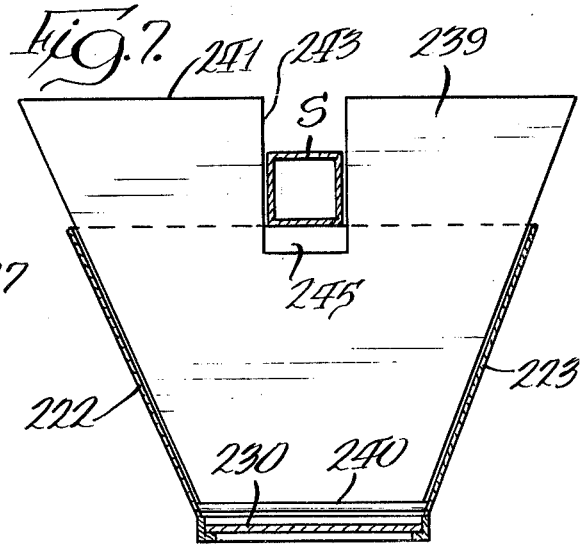
FIG. 7 is a sectional view on an enlarged scale taken substantially as indicated along the line 7—7 of FIG. 6.

Turning now to the third embodiment of FIGS. 6 and 7, a structural beam or sill S extends longitudinally along the bottom of a cargo body so it is just at the top of a depending hopper structure 221 which has a first fixed sidewall 222 and a second fixed sidewall (not shown), and which also has a fixed connecting wall 224 and a pivoted connecting wall 225 which is mounted for swinging movement on a pivot 227. A controlled discharge bottom closure 230 is the same as the controlled discharge bottom closures 30 and 130.

The third embodiment of FIGS. 6 and 7 differs from the first embodiment of FIGS. 1 to 3 principally in the construction of its diverter panel 239 which is carried upon a shaft 240; the diverter panel 239 having its upper margin 241 provided with a clearance notch 243 which accommodates the movement of the panel 239 about the beam or sill S. Since the bottom of the clearance notch 243 must clear the bottom of the structural beam S when the panel is in its vertical position swinging from the full line position of FIG. 6 to the broken line position of FIG. 6, complete diversion of material toward the opening at the pivoted connecting wall 225 requires that there be a filler member or baffle 244 at the upper end of the fixed connecting wall 224 to prevent material from dropping through the notch. The filler member 244 is only very little wider than the structural beam so as to block the clearance notch 243 while not interfering with material discharge. In addition, to prevent loss of material during controlled discharge a baffle 245 obstructs the notch 243 in that position.

Figure 8:
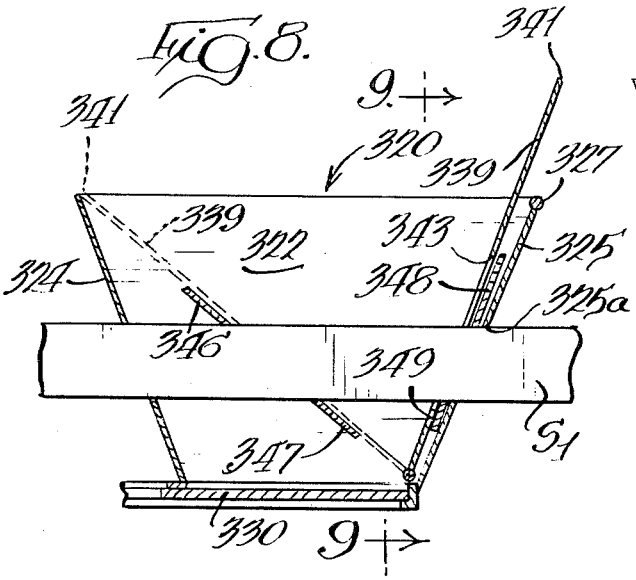
FIG. 8 is a longitudinal sectional view of a device similar to that of FIG. 6; but adapted to the situation in which a bulk cargo carrying wheeled vehicle has a beam or sill below its bottom where it extends entirely through the hopper device; the diverter panel being illustrated in solid lines in its controlled discharge position and in broken lines in its uncontrolled discharge position.
Figure 9:
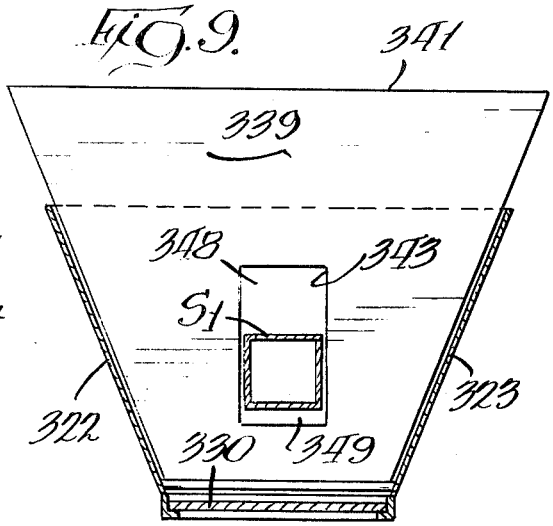
FIG. 9 is a sectional view taken substantially as indicated along the line 9—9 of FIG. 8.

Referring to FIGS. 8 and 9, the fourth embodiment of the invention accommodates the device to a bulk cargo carrying vehicle which has a longitudinal structural beam or sill S1 which is spaced below the cargo body so that an entire dual hopper device 320 must be built around it. In this case, therefore, the structural beam S1 is between the fixed sidewall 322 and a second fixed sidewall (not shown), and extends through a fixed connecting wall 324 and a pivoted connecting wall 325 which is pivoted at 327. A controlled discharge bottom closure 330 is identical to and functions like the prior controlled discharge bottom closure.

In order to accommodate the device 320 to the structural beam S1, a diverter panel 339 has a clearance opening 343 which accommodates its movement about the beam S1, and the pivoted connecting wall 325 has a clearance opening 325*a* which accommodate its movement about the beam.

The size of the clearance opening 343 is such that first inclined baffle means 346 and 347 must be mounted above and below the structural beam S1 to close the clearance opening 343 in the inclined position of the diverter panel 339; and second baffle means 348 and 349 is mounted above and below the structural beam S1 confronting the pivoted connecting wall 325 so as to close the diverter panel clearance opening 343 and the clearance opening 325*a* of the connecting wall 325 in the controlled discharge position of the panel.

Figure 10:
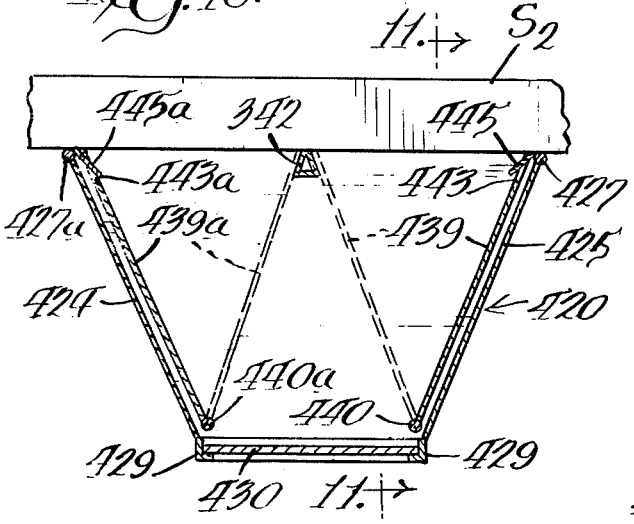
FIG. 10 is a sectional view of a structure like that of FIGS. 4 and 5, modified to adapt it to a bulk cargo carrying vehicle which has a beam or sill at the bottom of the cargo body, the two pivoted diverter panels being illustrated in full lines in their controlled discharge positions and in broken lines in their uncontrolled discharge positions.

Referring now to the fifth embodiment illustrated in FIGS. 10 and 11, it is seen that it is the second embodiment modified to accommodate it to a bulk cargo carrying vehicle in which a structural beam or sill S2 is located in the bottom of the cargo body immediately above the dual discharge device which is indicated generally at 420. Here, as in the second embodiment, there are pivoted connecting walls 424 and 425 which are pivotally mounted, respectively, on pivots 427*a* and 427. There is a controlled discharge bottom closure 430 in channels 429 which have extensions 429*a* past the fixed sidewall 422, and there are diverter panels 439 and 439*a* which are mounted, respectively, on shafts 440 and 440*a*. The top ends of the respective diverter panels 439 and 439*a* are provided with clearance notches 443 and 443*a* to accommodate the movement of the two diverter panels; and a cross bar 342 which supports the upper ends of the diverter panels in uncontrolled discharge position also acts as a baffle to close the clearance notches 443 and 443*a*. In addition, because said clearance notches leave a small gap at the top of the connecting walls 424 and 424*a*, there is a short inclined baffle 445 mounted on the upper end of the pivoted connected wall 425, and a similar baffle 445*a* mounted on the top of the pivoted connecting wall 424.

Figure 12:
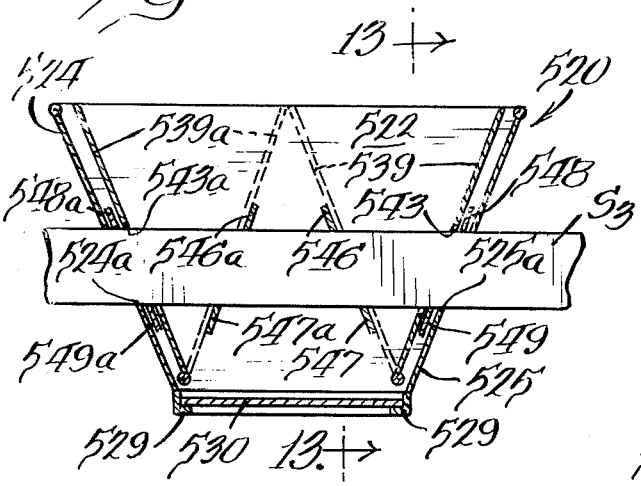
FIG. 12 is a sectional view of a structure like that of FIG. 4 modified to adapt it to a cargo body of the kind seen in FIGS. 8 and 9.

Referring now to the sixth embodiment illustrated in FIGS. 12 and 13, it is seen that this embodiment is the dual discharge structure of the second embodiment modified to adapt it to a cargo carrying vehicle in which a structural beam or sill S3 is positioned below the floor of the cargo body where a dual discharge hopper structure 520 must be built around it. In this case, again, the structural beam S3 is in a plane between the fixed sidewalls 522 and 523 and is parallel to the bottom wall of the cargo body. A controlled discharge bottom closure 530 is carried in channels 529 which have extensions 529*a* past the fixed sidewall 522. The pivoted connecting walls 524 and 525 are provided, respectively, with clearance openings 524*a* and 525*a* to accommodate the movement of said pivoted connecting walls; and the diverter panels 539 and 539*a* are provided with respective clearance openings 543 543*a*.

The clearance opening 543 is blocked in the uncontrolled discharge position by baffles 546 and 547; while the clearance opening 543*a* is blocked by baffles 546*a* and 547*a*. Baffles 548 and 549 block egress of material through the clearance openings 525*a* and 543 in the controlled discharge position, and in that position the clearance openings 524*a* and 543*a* are blocked by baffles 548*a* and 549*a*.

The foregoing detailed description is given for clearness of understanding only and no unnecessary limitations should be understood therefrom as modifications will be obvious to those skilled in the art.

I claim:

1. A dual discharge hopper device for the cargo body of a bulk cargo carrying wheeled vehicle, said body having a bottom wall provided with a rectangular opening, said dual discharge hopper device comprising, in combination:

a depending structure having two fixed sidewalls which bound first parallel sides of said rectangular opening, and two connecting walls which bound second parallel sides of said opening, one of said connecting walls being mounted on a pivot the axis of which extends between the fixed sidewalls immediately adjacent the bottom of the cargo body so that said one of said connecting walls may selectively abut the fixed sidewalls or swing clear of said sidewalls for uncontrolled discharge of material from the cargo body;

controlled discharge closure means at the lower end of said depending structure;

discharge control means for moving said controlled discharge closure means to any desired point between a closed position in which it completely blocks the lower end of the structure and a fully open position in which said lower end is effectively unobstructed;

and a diverter panel mounted on a horizontal shaft that extends between the lower ends of the sidewalls immediately adjacent said one of said connecting walls, said diverter panel being movable between a generally upright controlled discharge position confronting said one of the connecting walls, and an uncontrolled discharge position inclined across the structure so the lower end of the structure is completely obstructed.

2. The combination of claim 1 in which the other of said connecting walls is fixed between the sidewalls, and the diverter panel in its uncontrolled discharge position has its upper end effectively abutting said other of said connecting walls.

3. The combination of claim 2 in which the entire depending structure is unobstructed by any vehcile structural beam.

4. The combination of claim 2 in which a vehicle structural beam is in the bottom of the cargo body in a plane between the sidewalls and extending through the connecting walls of the depending structure, the diverter panel spans said beam and has a clearance notch in its upper end accommodating the movement of the panel about the beam, and a filler member at the upper end portion of the other of said connecting walls closes the lower part of said notch in the uncontrolled discharge position of the diverter panel.

5. The combination of claim 4 which also includes a baffle member at the upper end of the pivoted connecting wall to close the clearance opening in said pivoted connecting wall and in the diverter panel in the controlled discharge position of said panel.

6. The combination of claim 2 in which a vehicle structural beam extends through the connecting walls and the diverter panel, said pivoted one of said connecting walls and said diverter panel each has a clearance opening accommodating its movement about said beam, first inclined baffle means is mounted generally centrally of the beam to close the diverter panel clearance opening in the discharge position of said diverter panel, and second baffle means is mounted on said beam confronting said one of said connecting walls to close the diverter panel clearance opening and the pivoted connecting wall clearance opening in the controlled discharge position of said panel.

7. The combination of claim 1 in which the other of said connecting walls is mounted on a second pivot which extends between the fixed sidewalls immediately adjacent the bottom of the cargo body so that said other of said connecting walls may also selectively abut the fixed sidewalls or swing clear of said sidewalls for uncontrolled discharge of material from the cargo body between both ends of the fixed sidewalls, and in which a second diverter panel is mounted on a second shaft that extends between the lower ends of the sidewalls immediately adjacent said other of said connecting walls, said second diverter panel being movable between a generally upright controlled discharge position confronting said other of said connecting walls, and an uncontrolled discharge position inclined across the structure, and there being stop means upon which each of the diverter panels rests in its uncontrolled discharge position, the upper ends of said diverter panels effectively abutting one another when both are in said uncontrolled discharge position.

8. The combination of claim 7 in which the entire depending structure is unobstructed by any vehicle structural beam, and in which the stop means comprises a bar parallel to, equidistant from, and effectively in the horizontal plane of the pivots for the connecting walls, and in which the upper end portions of both diverter panels rest on said bar in uncontrolled discharge position.

9. The combination of claim 7 in which a vehicle structural beam is in the bottom of the cargo body in a plane between the sidewalls and normal to the connecting walls of the depending structure, both diverter panels span said beam and have clearance notches in their upper ends to accommodate movement of said panels about the beam, and a filler member immediately beneath the beam closes the lower ends of both said notches in the uncontrolled discharge positions of said panels.

10. The combination of claim 9 which also includes baffle members at the upper ends of the pivoted connecting walls to close the clearance openings in said walls and in the diverter panels in the controlled discharge positions of said panels.

11. The combination of claim 7 in which a vehicle structural beam extends through the connecting walls and said diverter panels, each of said connecting walls and each of said diverter panels has a clearance opening accommodating its movement about said beam, the stop means for each diverter panel comprises inclined baffle plates mounted on the beam which close the diverter panel clearance openings in the uncontrolled discharge positions of said panels, and in which a baffle means is mounted on said beam confronting each of the connecting walls to close the clearance openings of both said diverter panels and of both said pivoted connecting walls in the controlled discharge positions of said panels.

12. The combination of claim 7 which includes means on each shaft outside a fixed sidewall for applying torque to said shaft.

13. The combination of claim 1 in which the discharge control means comprises horizontal parallel tracks mounted on and extending across the lower end of the depending structure and projecting from a side of said structure for a distance equal to the width of said lower end, and in which the controlled discharge closure is a single rectangular plate mounted on said tracks for rectilinear movement.

14. The combination of claim 13 which includes rack and pinion means on the tracks and on the rectangular plate.

15. The combination of claim 1 in which the depending structure is in the shape of a frustum of a pyramid with at least the connecting walls inclined.

16. The combination of claim 1 in which the depending structure is in the shape of a frustum of a pyramid with both of the fixed sidewalls and both of the connecting walls inclined.

17. The combination of claim 1 in which the fixed sidewalls of the depending structure extend longitudinally of the cargo body.

18. The combination of claim 1 which includes means on the shaft outside a fixed sidewall for applying torque to said shaft.

* * * * *